US006796902B2

(12) United States Patent
Baerlocher et al.

(10) Patent No.: US 6,796,902 B2
(45) Date of Patent: Sep. 28, 2004

(54) GAMING DEVICE INCLUDING AWARDS THAT GENERATE ANOTHER AWARD

(75) Inventors: Anthony J. Baerlocher, Reno, NV (US); Paulina Glavich, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/966,663

(22) Filed: Sep. 28, 2001

(65) Prior Publication Data

US 2003/0064780 A1 Apr. 3, 2003

(51) Int. Cl.[7] ..... A63F 9/24

(52) U.S. Cl. ..... 463/20; 273/139

(58) Field of Search ..... 463/1–2, 7, 9–13, 463/16–21, 23, 30–31, 36–38, 138.1, 139, 236, 237, 242; 273/158.1, 139, 236, 237, 242

(56) References Cited

U.S. PATENT DOCUMENTS

| | | | | | |
|---|---|---|---|---|---|
| 4,182,515 | A | * | 1/1980 | Nemeth | 273/237 |
| 4,624,459 | A | | 11/1986 | Kaufman | |
| 4,695,053 | A | | 9/1987 | Vazquez, Jr. et al. | |
| 5,046,737 | A | * | 9/1991 | Fienberg | 273/139 |
| 5,342,047 | A | | 8/1994 | Heidel et al. | |
| 5,449,173 | A | | 9/1995 | Thomas et al. | |
| 5,743,524 | A | * | 4/1998 | Nannicola | 273/139 |
| 5,788,573 | A | * | 8/1998 | Baerlocher et al. | 463/16 |
| 5,823,874 | A | | 10/1998 | Adams | |
| 5,848,932 | A | | 12/1998 | Adams | |
| 5,873,781 | A | | 2/1999 | Keane | |
| 5,980,384 | A | | 11/1999 | Barrie | |
| 5,997,401 | A | | 12/1999 | Crawford | |
| 6,004,207 | A | * | 12/1999 | Wilson et al. | 463/20 |
| 6,015,346 | A | | 1/2000 | Bennett | |
| 6,016,338 | A | * | 1/2000 | Bansal et al. | 379/93.13 |
| 6,033,307 | A | * | 3/2000 | Vancura | 463/20 |
| 6,045,129 | A | * | 4/2000 | Cooper et al. | 273/292 |
| 6,056,642 | A | | 5/2000 | Bennett | |
| 6,059,289 | A | * | 5/2000 | Vancura | 273/143 R |
| 6,059,658 | A | | 5/2000 | Mangano et al. | |
| 6,089,976 | A | | 7/2000 | Schneider et al. | |
| 6,089,977 | A | | 7/2000 | Bennett | |
| 6,093,102 | A | * | 7/2000 | Bennett | 463/20 |
| 6,102,400 | A | | 8/2000 | Scott et al. | |
| 6,102,798 | A | * | 8/2000 | Bennett | 463/16 |
| 6,113,098 | A | | 9/2000 | Adams | |
| 6,120,031 | A | | 9/2000 | Adams | |
| 6,126,541 | A | | 10/2000 | Fuchs | |

(List continued on next page.)

FOREIGN PATENT DOCUMENTS

| | | | | |
|---|---|---|---|---|
| GB | 2144644 A | * | 3/1985 | G07F/17/32 |

OTHER PUBLICATIONS

Strictly Slots, Take your Pick, Mar. 2001, Anchor Games.*
Winning Bid Advertisement written by WMS Gaming Inc., published prior to 2001.
Texas Tea Brochure written by IGT, published in 2000.
Fortune Hunter Advertisement written by Aristocrat Leisure Industries Pty Ltd., published in Sep. 1995.
Catch A Wave Advertisement written by IGT, published in 2001.
Dolphin Treasure Advertisement written by Aristocrat Leisure Industries Pty Ltd., published in 1996.

*Primary Examiner*—Jessica Harrison
*Assistant Examiner*—Alex F. R. P. Rada, II
(74) *Attorney, Agent, or Firm*—Bell, Boyd & Lloyd LLC

(57) ABSTRACT

The present invention includes a gaming device and preferably a bonus round of a gaming device having a processor and a game that presents one or more selectable choices to a player. After a selection is made, the processor accesses an award database and generates an award for the player. Certain awards of the database provide pecuniary gain outcomes, such as a gaming device credit or a game multiplier. One or more supplementing awards of the database include a pecuniary gain outcome and an additional award generation outcome.

63 Claims, 6 Drawing Sheets

U.S. PATENT DOCUMENTS 6,126,542 A 10/2000 Fier
6,142,874 A 11/2000 Kodachi et al.
6,142,875 A 11/2000 Kodachi et al.
6,146,273 A 11/2000 Olsen
6,149,156 A * 11/2000 Feola ..... 273/292
6,159,095 A 12/2000 Frohm et al.
6,159,097 A 12/2000 Gura
6,159,098 A 12/2000 Slomiany et al.
6,173,955 B1 1/2001 Perrie et al.
6,174,235 B1 1/2001 Walker et al.
6,186,894 B1 2/2001 Mayeroff
6,190,254 B1 2/2001 Bennett
6,190,255 B1 * 2/2001 Thomas et al. ..... 463/20
6,203,429 B1 3/2001 Demar et al.
6,224,482 B1 5/2001 Bennett
6,224,483 B1 * 5/2001 Mayeroff ..... 463/20
6,227,969 B1 5/2001 Yoseloff
6,231,442 B1 5/2001 Mayeroff
6,231,445 B1 5/2001 Acres
6,261,177 B1 7/2001 Bennett
6,270,409 B1 8/2001 Shuster
6,270,412 B1 8/2001 Crawford et al.
6,309,300 B1 10/2001 Glavich
6,312,334 B1 11/2001 Yoseloff
6,315,660 B1 * 11/2001 DeMar et al. ..... 463/16
6,439,995 B1 * 8/2002 Hughs-Baird et al. ..... 463/20
6,569,015 B1 5/2003 Baerlocher et al.

* cited by examiner

GAMING DEVICE INCLUDING AWARDS THAT GENERATE ANOTHER AWARD

CROSS REFERENCE TO RELATED APPLICATIONS

This application relates to the following co-pending commonly owned patent applications: "GAMING DEVICE HAVING A BONUS SCHEME WITH MULTIPLE SELECTION GROUPS," Ser. No. 09/656,702; "GAMING DEVICE HAVING A BONUS ROUND WITH MULTIPLE RANDOM AWARD GENERATION AND MULTIPLE RETURN/RISK SCENARIOS," Ser. No. 09/678,989; "GAMING DEVICE HAVING BONUS SCHEME WITH INCREMENTAL VALUE DISCLOSURE," Ser. No. 09/627,198; "GAMING DEVICE HAVING AN AWARD EXCHANGE BONUS ROUND AND METHOD FOR REVEALING AWARD EXCHANGE POSSIBILITIES," Ser. No. 09/689,510; "GAMING DEVICE WITH A BONUS SCHEME INVOLVING MOVEMENT ALONG PATHS WITH PATH CHANGE CONDITIONS," Ser. No. 09/686,538; "GAMING DEVICE HAVING A RE-TRIGGERING SYMBOLS BONUS SCHEME," Ser. No. 09/981,133; "DEVICE WITH A BONUS SCHEME HAVING REPEATED SELECTION OF VALUE SETS WITH OPTION TO SAVE VALUES," Ser. No. 09/684,533; "GAMING DEVICE HAVING A BONUS SCHEME INCLUDING A PLURALITY OF SELECTION GROUPS WITH WIN-GROUP OUTCOMES," Ser. No. 09/981,084, "GAMING DEVICE HAVING DUAL EVALUATION SCHEME," Ser. No. 09/687,689; "GAMING DEVICE HAVING TEASE REVEAL FEATURE," Ser. No. 09/957,583; "GAMING DEVICE HAVING AN ACCUMULATED AWARD SELECTION BONUS SCHEME," Ser. No. 09/963,721; and "GAMING DEVICE HAVING A RE-TRIGGERING SYMBOL BONUS SCHEME WITH A BONUS SYMBOL ACCUMULATOR," Ser. No. 10/071,441.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having player selectable selections and at least one associated award database, wherein one or more awards of the database generate another award.

BACKGROUND OF THE INVENTION

Known games of gaming devices provide a player with one or more opportunities to select masked bonus awards from a pattern or group of masked awards displayed to the player. When the player selects a masked award, the player receives the value of the award, and the game enables the player to select another masked award. The player selects another masked award and the process continues until the player selects a masked terminator. European Patent Application No. EP 0 945 837 A2 filed on Mar. 18, 1999 and assigned on its face to WMS Gaming, Inc. discloses a bonus scheme of this type.

That application discloses the possible outcome of a player's selection being either an award or a bonus terminator. Players desire variety in a gaming event. One way to provide variety is to vary the type of outcome that a player can receive. It is therefore desirable to provide a game that varies the possible outcomes of a gaming event beyond a win outcome or a lose outcome.

SUMMARY OF THE INVENTION

The present invention provides a gaming device and specifically a bonus round of a gaming device which includes one or more selections or selectable choices. The processor of the game accesses an award database and generates an award for each chosen selection. Certain awards in the database include a value or pecuniary gain outcome such as a gaming device credit or a game multiplier. One or more awards in the database are supplementing awards which include a pecuniary gain outcome and an additional award generation outcome. The supplementing awards may be associated with one or more of the selections or selectable choices.

Upon the receipt of a supplementing award, the present invention generates another award. The generated award can, in turn, be a regular award such as gaming device credit or a game multiplier, or another supplementing award. The game continues in this manner until a player does not generate a supplementing award. The game can alternatively have a set limit on the number of sequential supplementing awards allowed. For instance, the game can include only one supplementing award in a database and only enable the awards to be randomly generated a single time.

The present invention includes a game having a plurality of the above described award databases, wherein each particular database is associated with one or more player selectable selections. The present invention includes known input devices, such as one or more electro-mechanical pushbuttons or a touch screen display device. The present invention preferably includes a display device that can provide audio-visual sequences as the game enables the player to input choices, while the game generates an award and while the game provides the player with the award.

It is therefore an advantage of the present invention to provide a gaming device having at least one player selectable selection and at least one associated award database, wherein one or more awards in the database generates another award.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
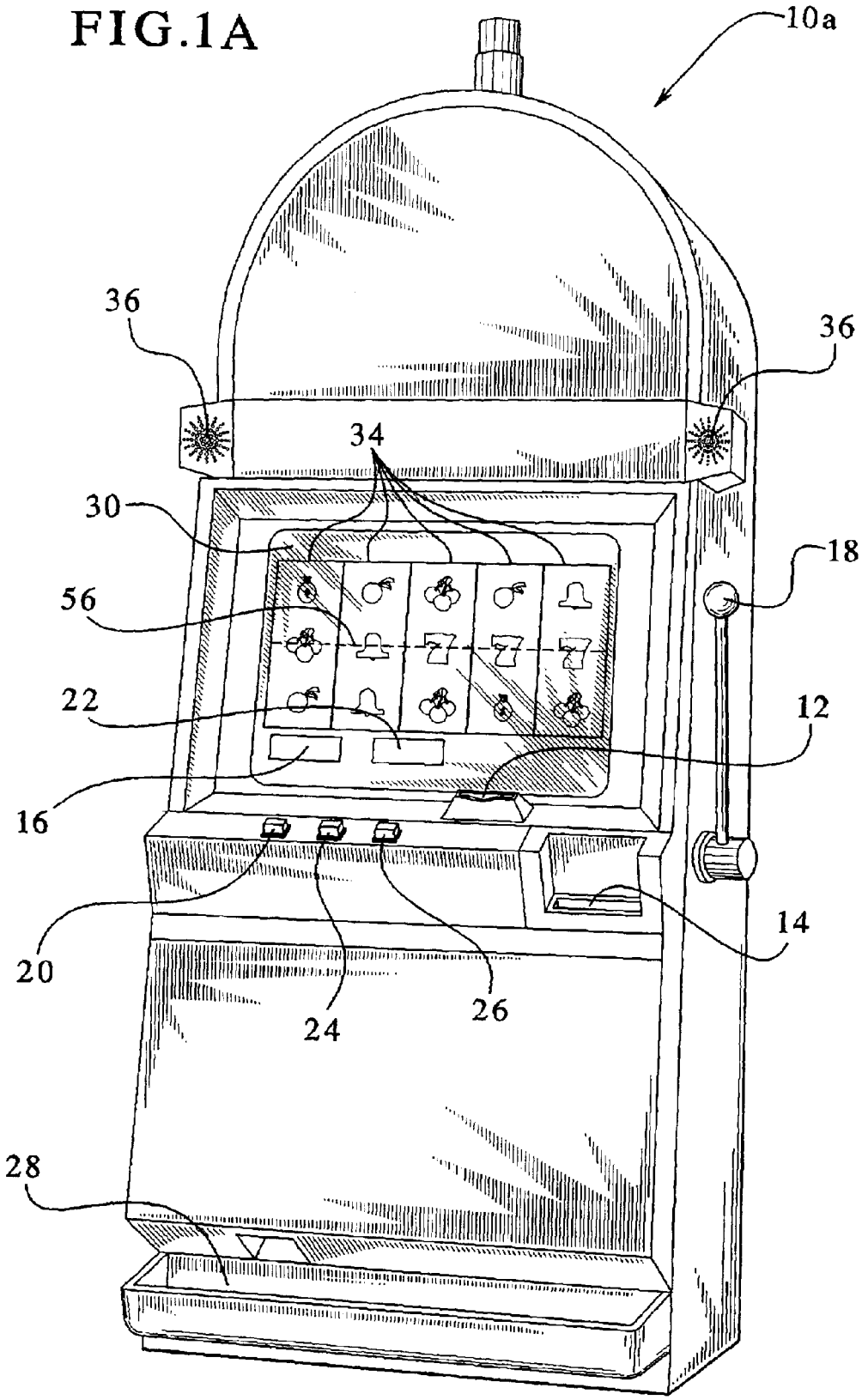
FIG. 1A is a front-side perspective view of one embodiment of the gaming device of the present invention.
Figure 1B:
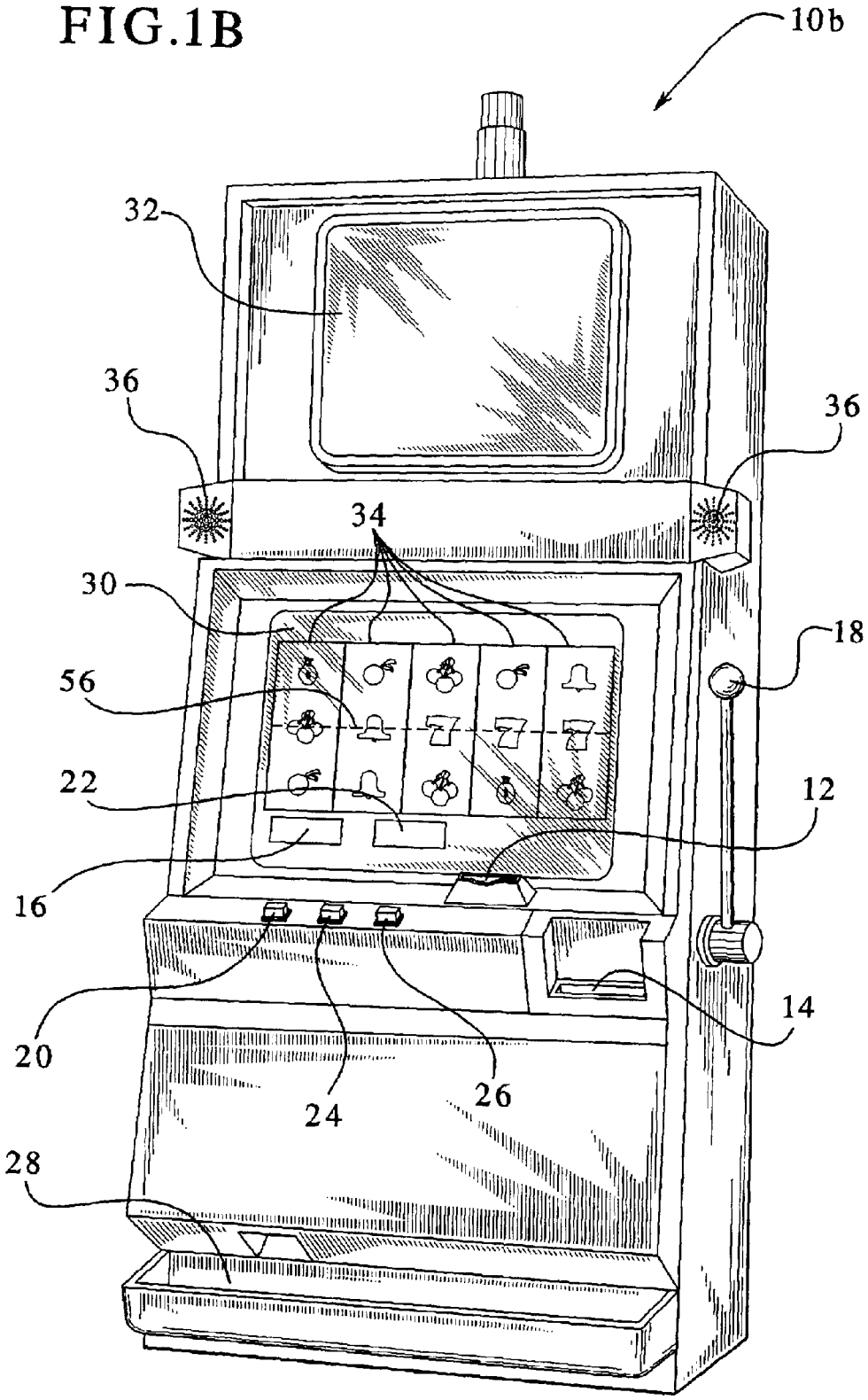
FIG. 1B is a front-side perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sifting, and gaming device 10 is preferably mounted on a console.

It should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money or a ticket voucher in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player, which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

At any time during the game, a player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit vouchers redeemable by a cashier or electronically recordable cards, which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other static or dynamic display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
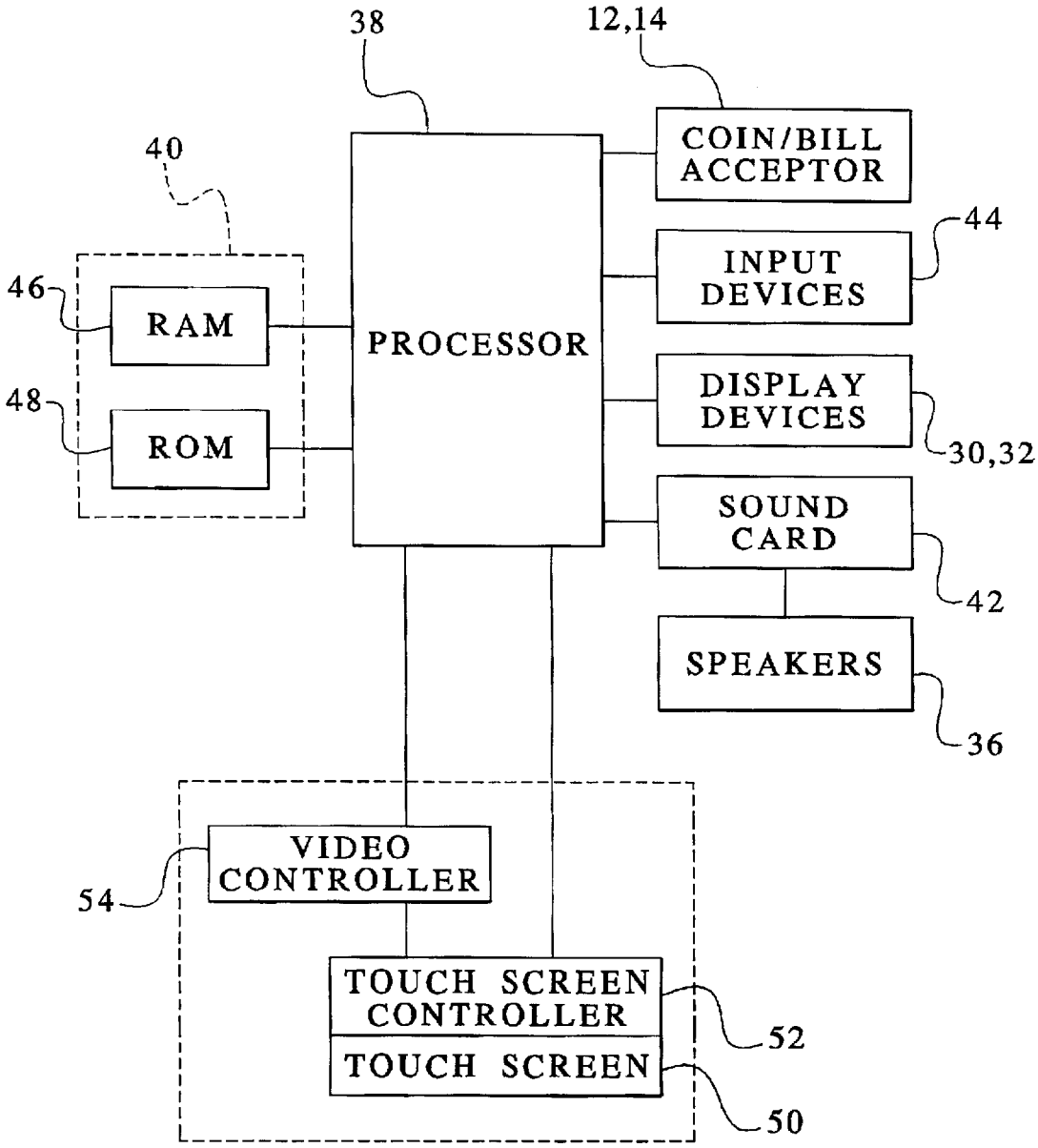
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hardwired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or the "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

The present invention includes a plurality of different playing screens and a plurality of differently configured databases. The present invention also includes a method by which a game generates and employs a supplementing award.

Figure 3:
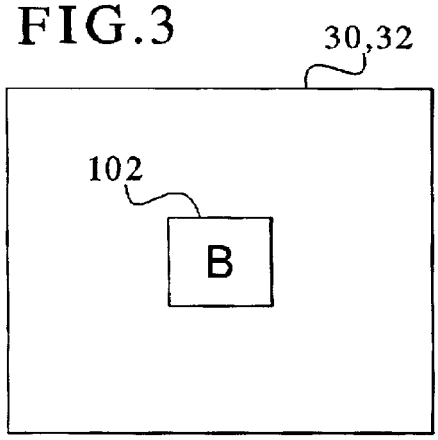
FIG. 3 is an enlarged front plan view of a display device including a player selectable selection, which is an area of a touch screen display.

Referring now to FIG. 3, a display device 30 or 32 includes a single player selectable choice or selection 102. In this embodiment, the choice or selection 102 is preferably an area of a touch screen display adapted such that when the game enables an input to be made to the processor 38 (FIG. 2), a player may touch the selection 102 and thereby send a discrete input to the processor 38. The game may not always enable the input, such that when the input is not enabled and the player selects the selection 102, the game does not send an input. The game enables the input at the appropriate time of a sequence, as described below.

The choice 102 preferably includes indicia, here the letter "A", which designates the selection. The selection 102 and its accompanying indicia can alternatively be an electromechanical input device, similar to the play button 20, the bet one button 24 and the cash out button 26 of FIGS. 1A and 1B. An electromechanical form of the selection 102 displays its identifying indicia in any suitable manner, such as illuminating the choice.

Figure 4:
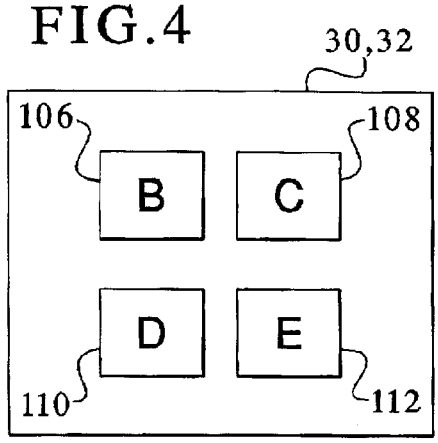
FIG. 4 is an enlarged front plan view of a display device including a plurality of player selectable selections, which are each areas of a touch screen display.

Referring now to FIG. 4, the display device 30 or 32 includes a plurality of player selectable selections 106, 108, 110 and 112. In this embodiment 104, the selections are again preferably areas of a touch screen display adapted such that when the game enables the inputs to the processor 38 of FIG. 2, a player may touch one or more of the selections 106, 108, 110 and 112 and thereby send one or more discrete inputs to the processor 38. In one embodiment of the present invention, the game only enables the player to input one selection of the selections 106, 108, 110 and 112. In another embodiment, the game enables a plurality of inputs such as two of the selections 106, 108, 110 and 112.

The selections preferably each include identifying indicia, here the letters "B," "C," "D" and "E," respectively. The selections 106 through 112 and their accompanying indicia may alternatively be separate electromechanical input devices as described above.

Figure 5:
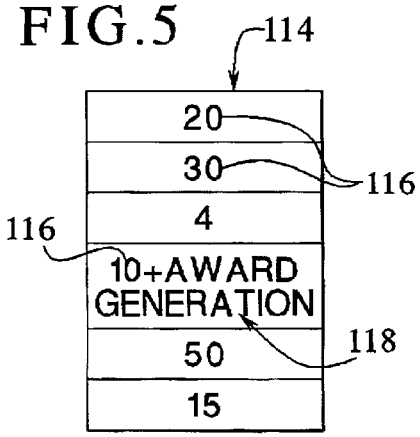
FIG. 5 is a schematic view of a portion of a database that includes a plurality of game awards and a supplementing award of the present invention.

Referring now to FIG. 5, the database 114 includes a plurality of awards 116 and at least one supplementing award 118. The database 114 is preferably stored in the memory device 40 and is accessible by the processor 38 (FIG. 2). In one embodiment, the processor 38 accesses entries from a database, such as database 114, in the order in which the entries are placed. In FIG. 5, the processor of this embodiment accesses the "20" award first, the "30" award second, the "4" award third, etc. In this embodiment, the selections are predetermined based upon their order.

In a preferred embodiment, the processor 38 randomly generates an entry from the database 114 such that there is no predictable order. In one configuration of this embodiment, the processor is preset to pick any entry upon a random generation. In another configuration, the processor is preset to pick only previously unselected entries upon a random generation.

The awards 116 include any suitably providable item of value to a player, such as gaming device credits. The awards 116 are alternatively modifiers or multipliers. In one embodiment, the multipliers multiply a tally of credits, such as the amount of a player's total bet, bet per payline, total win, win per payline, or a win from a bonus round game. The awards 116 may include any number representing a pecuniary value, such as a number of picks from a prize pool, wherein the prize pool includes values such as gaming device credits. The awards 116 may be adapted to provide one or more free games. The free game or games include free base games or free bonus games.

The supplementing awards 118 include an award 116, as described above, plus an additional award generation. For instance, the supplementing award 118 of FIG. 5 includes the award 116 of ten game credits and an additional award generation, whereby the game generates (preferably randomly) another award 116 or another supplementing award 118. The supplementing awards are alternatively linked or fixed to another award, such that upon a generation of a supplementing award, the game automatically provides an additional predetermined award. The present invention preferably randomly generates an award or automatically links to an award from the same database that produces the supplementing award 118. The processor 38 alternatively generates awards from a second database upon generating a supplementing award 118 from a first database.

The present invention contemplates a random additional award generation or a predetermined link having a plurality of effects or outcomes. In a first effect or outcome, the game generates or links to the additional award and provides the award to the player without player interaction or player input. For example, referring to FIG. 4, if the player selects the "B" selection 106, which has been randomly assigned a supplementing award, the game provides the award 116 associated with the supplementing award and randomly selects or is automatically linked to another award, e.g., the award associated with the "C" choice 108, and provides the "C" choice award to the player. That is, the game provides the award 116 or supplementing award 118 associated with another choice. In an embodiment, the game only picks an award 116 or supplementing award 118 associated with an unselected choice. The game preferably informs the player of the supplementing award, to increase enjoyment and excitement, by visually and/or audibly displaying that the player wins the award associated with the "C" selection 108.

In an alternative effect or outcome, the random additional award generation or the predetermined link includes providing the player with an extra pick or selection, whereby the pick or selection designates the additional award that the game provides the player. For example, referring to FIG. 4, if the player selects the "B" selection 106, which has been randomly assigned a supplementing award, the game provides the award 116 associated with the supplementing award and provides the player, via a suitable prompt, with another selection or pick. The game preferably visually and/or audibly prompts the player to make the supplementing or additional selection. The present invention includes enabling the player to select any displayed choice even previously selected ones. The game alternatively links to a predetermined selection, whereby the player executes or picks the selection. The game further alternatively restricts the player to select any previously unselected selection. If the player's extra pick is the "C" selection 108, the game provides the associated "C" award to the player.

In an embodiment having multiple player selections, wherein any selection can yield a supplementing award, the present invention contemplates providing the supplementing award at a plurality of different stages of the game. For example, referring to FIG. 4, if the player is allowed to pick any two selections, whereafter the game reveals awards of the selections, the present invention reveals the game awards of all the picked selections before revealing the supplementing awards. The present invention alternatively reveals the supplementing choice directly after revealing the game award associated with the supplementing award.

The game may be adapted to provide a separate display for the supplementing awards 118. In an embodiment, the game provides an electromechanical display (not illustrated) separate and distinct from the display devices 30 and 32. In an alternative embodiment, one of the display devices 30 or 32 provides a separate and distinct area for displaying the supplementing awards 118.

The present invention may be adapted so that a supplementing award 118 randomly regenerates itself or another supplementing award one or more times. In FIG. 5, for example, upon a first generation of the supplementing award 118, which includes the ten award 116 and the additional award generation, the game can generate the same supplementing award 118 a second time, a third time, a fourth time, etc. The game alternatively limits the amount of additional generations. In one configuration, the game has a preset limit, such that the game only generates a particular supplementing award 118 a predetermined number of times. In another configuration, the implementor places only one supplementing award 118 in a database and presets the processor to select only previously unselected entries. In a further alternative embodiment, the supplementing award automatically links to a predetermined non-supplementing award. Alternatively, the game only generates an award from previously unselected awards.

Figure 6:
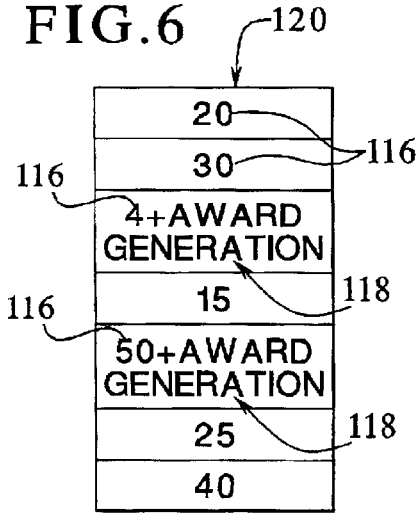
FIG. 6 is a schematic view of a portion of a database that includes a plurality of game awards and a plurality of supplementing awards of the present invention.

Referring now to FIG. 6, a schematic view of a database 120 illustrates a plurality of awards 116 and a plurality of supplementing awards 118 of the present invention. The present invention contemplates placing any number, distribution and percentage of supplementing awards 118 in any one database. The supplementing awards 118 may be adapted to have the same or different awards 116. The supplementing awards 118 may be adapted to additionally generate an award from the same database or a different database, and preferably the same database. The supplementing awards 118 may be adapted to additionally generate other supplementing awards and be subject to a supplementing award limit as discussed above.

Figure 7:
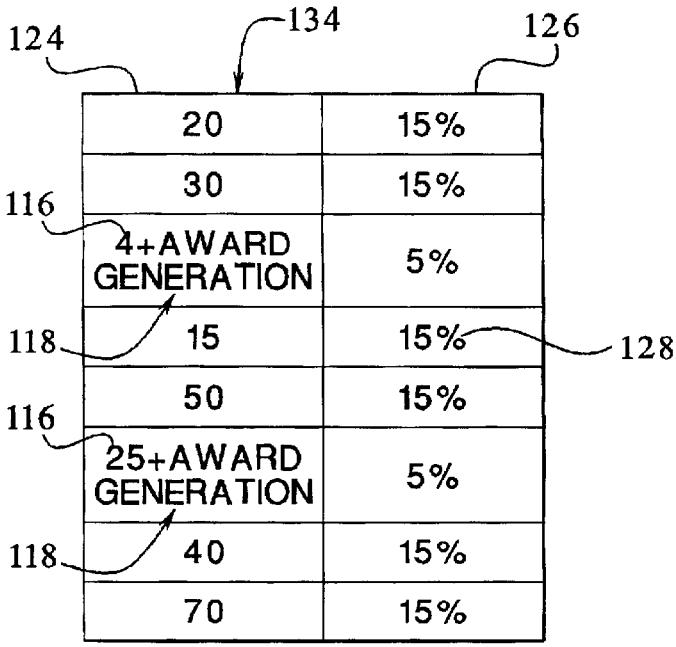
FIG. 7 is a schematic view of a portion of a database that includes a plurality of game awards and a plurality of supplementing awards of the present invention, wherein the awards are weighted.

Referring now to FIG. 7, a schematic view of a database 122 illustrates that in an embodiment wherein the game randomly generates awards 116 and supplementing awards 118, the present invention alternatively weights the awards 116 and supplementing awards 118, such that the game is more likely to choose one database entry more often than at least one other database entry. The database 122 includes a column 126 having a probability 128 for each award 116 and supplementing award 118, which designates the likelihood of generating an entry. In the database 122, the game is more likely to select an award 116 than a supplementing award 118 based on the percentages. The present invention includes any probability distribution, wherein the percentages preferably add to 100 percent. It should be appreciated that although the supplementing awards 118 are randomly generated, the present invention includes randomly generating or linking to a predetermined supplementing award.

Figure 8A:
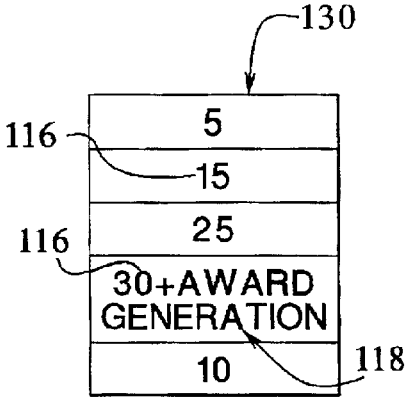
FIGS. 8A and 8B are schematic views of a portion of two databases each having a supplementing award, wherein the present invention employs both databases in a single game.
Figure 8B:
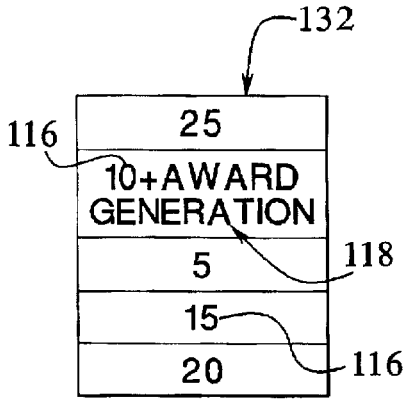
Figure 9A:
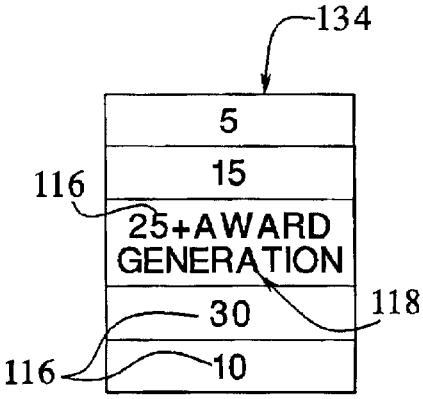
FIGS. 9A through 9D are schematic views of portions of four databases each having a supplementing award, wherein the present invention employs the four databases in a single game.
Figure 9B:
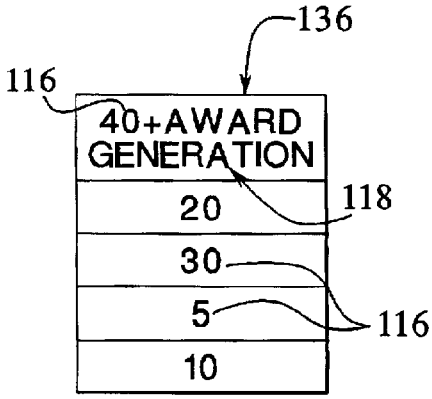
Figure 9C:
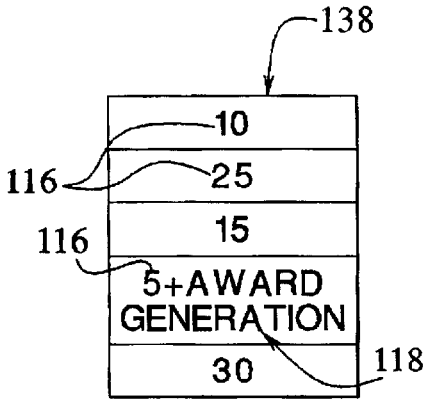
Figure 9D:
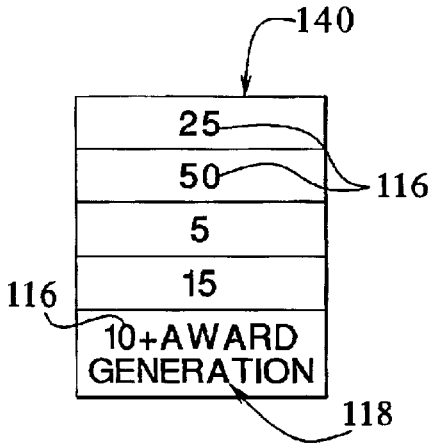

Referring now to FIGS. 8A and 8B, schematic views of two databases 130 and 132 having a supplementing award 118 and plurality of awards 116 illustrate an embodiment, wherein the present invention employs both databases in a single game. In a game having a plurality of player selectable selections, such as the embodiment 104 of FIG. 4, which includes the selections 106, 108, 110 and 112, the processor, upon an input accesses one or alternatively more than one database. For example, in one configuration the processor is adapted to access the database 130 of FIG. 8A upon the player's pick of the "B" of selection 106 or the pick of the "E" of selection 112. The processor is likewise adapted to access the database 132 of FIG. 8B upon the player's pick of the "C" of selection 108 or the pick of the "D" of selection 110.

The processor is preferably adapted to enable any database distribution in a multi-choice embodiment. For example, FIGS. 9A through 9D are schematic views of four databases having supplementing awards 118 and awards 116. In a game having a plurality of player selectable selections, such as in the embodiment 104 of FIG. 4, the selections 106, 108, 110 and 112 are each associated with a separate database, e.g., the database 134, the database 136, the database 138 and the database 140, respectively. In an alternative configuration one or more of the databases is weighted. Multiple databases provide variety and enable the game to include different types of awards, e.g., credits or multipliers, in the same game, upon different inputs.

Figure 10:
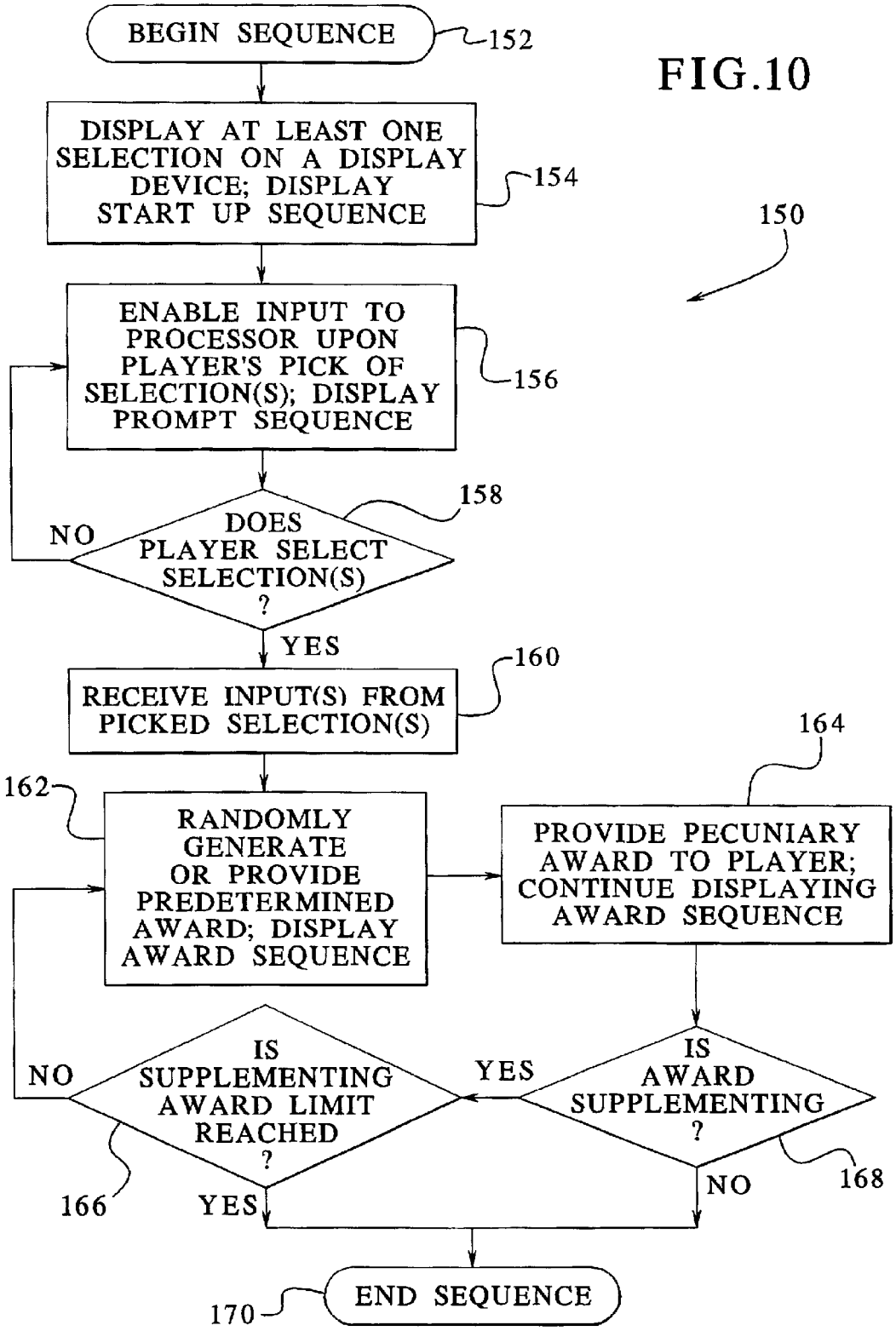
FIG. 10 is a flow diagram of one method of the present invention.

Referring now to FIG. 10, one method 150 of the present invention is illustrated. Upon a sequence triggering event, as indicated by the oval 152, the game displays one or more selections on a display device (or on one or more electromechanical devices). The display device also preferably displays an audiovisual start up sequence, as indicated by the block 154. The audiovisual start up sequence is preferably adapted to increase player enjoyment and excitement and preferably incorporates the selections into a theme of the game.

The game enables the player to input one or more picks and suitably prompts the player, as indicated by the block 156. The prompt is audio, visual or audiovisual and preferably directs the player to pick one or more enabled selections. The game continuously enables the input(s) and continuously prompts the player until the player picks the enabled number of selections.

Upon picking one or more selection, as indicated by a positive outcome of the diamond 158, the processor 38 receives the input(s) associated with the selection(s), as indicated by the block 160. The processor 38 generates an award 116 and displays a preferably enjoyable and exciting, theme consistent award sequence, as indicated by the block 162. The game provides any generated pecuniary award 116 and associated display sequence to the player, as indicated by the bock 164.

If the processor generates a supplementing award, the game determines if a supplementing award limit has been triggered, as indicated by the diamond 168. If a supplementing award limit has not been triggered, the game generates, i.e., randomly generates or is automatically linked to, another award, as indicated by the block 162.

If the game does not generate a supplementing award or generates a supplementing award but has triggered a supplementing award limit, the game ends the sequence as indicated by the oval 170. It should be appreciated that the present invention includes generating, i.e., randomly generating or automatically linking to, additional supplementing awards as long as the game does not reach a supplementing award limit.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is hereby claimed as follows:

1. A gaming device comprising:

a processor;

a game controlled by the processor and displayed by a display device;

a plurality of selections in the game;

a plurality of awards associated with said selections; and at least one supplementing award associated with at least one of said selections, said supplementing award adapted to be provided to a player by the processor when the player picks the selection associated with the supplementing award, each supplementing award including an award which is automatically provided to the player and at least one additional award generation which automatically provides an independently randomly determined guaranteed additional award to the player for said supplementing award.

2. The gaming device of claim 1, wherein the selections are player selectable.

3. The gaming device of claim 1, which includes at least one database of said awards and said supplementing awards accessible by the processor.

4. The gaming device of claim 1, which includes a plurality of databases accessible by the processor, wherein each database has a number of awards and at least one supplementing award.

5. The gaming device of claim 1, wherein each award generation provides a number of game credits or a game credit multiplier.

6. The gaming device of claim 1, wherein said additional award includes a number of free games.

7. The gaming device of claim 1, wherein said award generation includes an additional selection.

8. The gaming device of claim 7, wherein said additional selection is one of the plurality of selections not previously selected.

9. The gaming device of claim 1, wherein said award generation yields another supplementing award.

10. The gaming device of claim 9, wherein said another supplementing award is associated with one of the plurality of selections not previously selected.

11. The gaming device of claim 1, wherein a plurality of supplementing awards are displayed on an electromechanical device controlled by the processor.

12. The gaming device of claim 1, which includes a supplementing award limit defining a maximum number of supplementing awards associated with said selections.

13. A gaming device comprising:

a processor;

a game controlled by the processor and displayed by a display device;

a plurality of selections in the game;

a plurality of awards associated with said selections; and at least one supplementing award associated with said selections and adapted to be provided to a player by the processor, said supplementing award including an award which is automatically provided to the player and a random award generation which automatically provides an independently randomly determined guaranteed additional award to the player for said supplementing award.

14. The gaming device of claim 13, wherein the processor randomly generates said supplementing award from among the plurality of awards.

15. The gaming device of claim 13, wherein the selections are player selectable.

16. The gaming device of claim 13, wherein said award associated with said supplementing award is a game credit or a game credit multiplier.

17. The gaming device of claim 13, wherein said random award generation yields an award, a supplementing award, an additional pick of a selection or a free game.

18. The gaming device of claim 13, which includes storage means accessible by the processor for storing a plurality of groups of awards and supplementing awards.

19. A gaming device comprising:

a processor;

a game controlled by the processor and displayed by a display device;

a plurality of awards in the game; and a plurality of supplementing awards in the game adapted to be provided to a player by the processor, each of said supplementing awards including one of the awards which is automatically provided to the player and an award generation that chooses one of the plurality of awards which is an independently randomly determined guaranteed additional award automatically provided to the player for said supplementing award.

20. The gaming device of claim 19, wherein the award generation chooses from remaining unselected awards of the plurality of awards.

21. A gaming device comprising:

a display device; and a processor adapted to communicate with said display device; said display device and said processor adapted to:

(a) enable a player to pick at least one selection from a plurality of selections;

(b) generate a supplementing award associated with one of said selections;

(c) automatically provide an award to the player associated with said supplementing award it the player picks the selection associated with the supplementing award; and (d) provide an award generation associated with said supplementing award if the player picks the selection associated with the supplementing award, which automatically provides an independently randomly determined guaranteed additional award to the player for said supplementing award.

22. The gaming device of claim 21, wherein said display device and said processor are adapted to provide at least one additional supplementing award as an outcome of the award generation.

23. The gaming device of claim 21, wherein said display device and said processor are adapted to provide at least one additional selection as an outcome of the award generation.

24. The gaming device of claim 21, wherein said award generation is a random generation.

25. A gaming device comprising:

a display device; and a processor adapted to communicate with said display device; said display device and said processor adapted to:

(a) enable a player to pick at least one selection from a plurality of selections;

(b) generate a supplementing award associated with one of said selections;

(c) automatically provide an award to the player associated with said supplementing award if the player picks the selection associated with the supplementing award; and (d) provide an award generation associated with said supplementing award if the player picks the selection associated with the supplementing award, wherein said award generation automatically yields an independently randomly determined guaranteed additional award provided to the player and another supplementing award which automatically provides a further independently randomly determined guaranteed award to the player for said supplementing award.

26. A gaming device comprising:

a processor;

a game controlled by the processor and displayed by a display device;

a plurality of selections in the game;

a plurality of awards associated with said selections;

at least one supplementing award associated with said selections, wherein the supplementing award includes an award which is automatically provided to the player and at least one additional award generation which automatically provides an independently randomly determined guaranteed additional award to a player;

a probability of selecting an award associated with each of the awards; and a processor operable to enable a player to pick one of the selections, randomly associate one of the awards with the picked selection based on the probabilities, automatically provide an award and at least one additional award generation that provides an independently randomly determined guaranteed additional award to the player when the supplementing award is associated with the picked selection and automatically provides one of the awards to the player when the supplementing award is not associated with the picked selection.

27. The gaming device of claim 26, wherein the probabilities associated with at least two of the awards are different.

28. The gaming device of claim 26, wherein the probabilities associated with each of the awards is the same.

29. The gaming device of claim 26, wherein the probability associated with the supplementing award is less than the probabilities associated with at least one of the awards.

30. The gaming device of claim 26, wherein the probability associated with the supplementing award is greater than the probabilities associated with at least one of the awards.

31. The gaming device of claim 26, wherein the selections are player selectable.

32. The gaming device of claim 26, which includes at least one database of said awards and said supplementing awards accessible by the processor.

33. The gaming device of claim 26, which includes a plurality of databases accessible by the processor, wherein each database has a number of awards and at least one supplementing award.

34. The gaming device of claim 26, wherein each award generation provides a number of game credits or a game credit multiplier.

35. The gaming device of claim 26, wherein said additional award includes a number of free games.

36. The gaming device of claim 26, wherein said award generation includes an additional selection.

37. The gaming device of claim 36, wherein said additional selection is one of the plurality of selections not previously selected.

38. The gaming device of claim 36, wherein said award generation yields another supplementing award.

39. The gaming device of claim 38, wherein said another supplementing award is associated with one of the plurality of selections not previously selected.

40. The gaming device of claim 36, wherein a plurality of supplementing awards are displayed on an electromechanical device controlled by the processor.

41. The gaming device of claim 36, which includes a supplementing award limit defining a maximum number of supplementing awards associated with said selections.

42. A method of operating a gaming device controlled by a processor, said method comprising:

(a) enabling a player to pick at least one selection from a plurality of selections;

(b) generating a supplementing award associated with one of said selections;

(c) automatically providing to the player an award associated with said supplementing award if the player picks the selection associated with the supplementing award; and (d) providing an award generation associated with said supplementing award if the player picks the selection associated with the supplementing award, which automatically provides an independently randomly determined guaranteed additional award to the player for said supplementing award.

43. The method of claim 42, which includes providing at least one database of said awards and said supplementing awards, which is accessible by the processor.

44. The method of claim 42, which includes providing a plurality of databases which are accessible by the processor, wherein each database has a number of awards and at least one supplementing award.

45. The method of claim 42, which includes providing a number of game credits or a game credit multiplier for each award generation.

46. The method of claim 42, wherein said additional award includes a number of free games.

47. The method of claim 42, which includes providing an additional selection for each award generation.

48. The method of claim 47, wherein said additional selection is one, of the plurality of selections not previously selected.

49. The method of claim 42, which includes providing another supplementing award for each award generation.

50. The method of claim 49, wherein said another supplementing award is associated with one of the plurality of selections not previously selected.

51. The method of claim 42, which includes displaying a plurality of supplementing awards on an electromechanical device controlled by the processor.

52. The method of claim 42, which includes determining a supplementing award limit which defines a maximum number of supplementing awards associated with said selections.

53. The method of claim 42, which includes associating a probability of selecting an award with each of the awards, wherein the awards are randomly associated with the selections based on the probabilities.

54. A method of operating a gaming device controlled by a processor, said method comprising:

(a) enabling a player to pick at least one selection from a plurality of selections;

(b) generating a supplementing award associated with one of said selections;

(c) automatically providing to the player an award associated with said supplementing award if the player picks the selection associated with the supplementing award; and (d) providing an award generation associated with said supplementing award if the player picks the selection associated with the supplementing award, wherein said award generation automatically yields an independently randomly determined guaranteed additional award provided to the player and another supplementing award which automatically provides a further independently randomly determined guaranteed award to the player for said supplementing award.

55. The method of claim 54, which includes providing at least one database of said awards and said supplementing awards, which is accessible by the processor.

56. The method of claim 54, which includes providing a plurality of databases which are accessible by the processor, wherein each database has a number of awards and at least one supplementing award.

57. The method of claim 54, which includes providing a number of game credits or a game credit multiplier for each award generation.

58. The method of claim 54, wherein said additional award includes a number of free games.

59. The method of claim 54, which includes providing an additional selection for each award generation.

60. The method of claim 59, wherein said additional selection is one of the plurality of selections not previously selected.

61. The method of claim 54, which includes displaying a plurality of supplementing awards on an electromechanical device controlled by the processor.

62. The method of claim 54, which includes determining a supplementing award limit which defines a maximum number of supplementing awards associated with said selections.

63. The method of claim 54, which includes associating a probability of selecting an award with each of the awards, wherein the awards are randomly associated with the selections based on the probabilities.

* * * * *

UNITED STATES PATENT AND TRADEMARK OFFICE

CERTIFICATE OF CORRECTION

PATENT NO. : 6,796,902 B2
DATED : September 28, 2004
INVENTOR(S) : Anthony J. Baerlocher et al.

It is certified that error appears in the above-identified patent and that said Letters Patent is hereby corrected as shown below:

Column 11,
Line 12, change “it” to -- if --.

Signed and Sealed this

Twenty-fifth Day of January, 2005

JON W. DUDAS
*Director of the United States Patent and Trademark Office*